United States Patent [19]

Semany

[11] 4,047,773

[45] Sept. 13, 1977

[54] FILE CABINET SECUREMENT STRUCTURE

[76] Inventor: Joseph G. Semany, 10947 Rossiter, Detroit, Mich. 48224

[21] Appl. No.: 583,237

[22] Filed: June 2, 1975

Related U.S. Application Data

[63] Continuation of Ser. No. 449,729, March 11, 1974, abandoned.

[51] Int. Cl.[2] ..... F16B 47/00; A47B 87/00

[52] U.S. Cl. ..... 312/111; 312/108; 312/346; 248/206 A

[58] Field of Search ..... 312/111, 108, 346, 333; 248/206 A; 220/23.83; 52/DIG. 4

[56] References Cited

U.S. PATENT DOCUMENTS

| | | | |
|---|---|---|---|
| 2,528,211 | 10/1950 | Civkin et al. | 52/DIG. 4 |
| 2,549,766 | 4/1951 | Benson | 248/206 A |
| 2,862,626 | 12/1958 | Clare | 248/206 A |
| 3,064,330 | 11/1962 | Skidmore | 248/206 A |
| 3,195,022 | 7/1965 | Staver | 335/285 |
| 3,254,440 | 6/1966 | Duggar | 46/239 |
| 3,323,849 | 1/1967 | Stark | 312/221 |
| 3,325,639 | 6/1967 | King | 248/206 A |
| 3,361,509 | 1/1968 | Levenberg | 312/221 |
| 3,609,934 | 10/1971 | O'Carroll | 52/DIG. 4 |
| 3,610,459 | 10/1971 | Hanson | 220/23.83 |
| 3,743,372 | 7/1973 | Ruggerone | 312/111 |
| 3,852,935 | 12/1974 | Jones | 52/DIG. 4 |
| 3,881,793 | 5/1975 | Anderson | 312/276 |
| 3,897,288 | 7/1975 | Fayling | 248/206 A |

FOREIGN PATENT DOCUMENTS

| | | | |
|---|---|---|---|
| 869,119 | 7/1949 | Germany | 312/108 |

*Primary Examiner*—Paul R. Gilliam
*Assistant Examiner*—Victor N. Sakran
*Attorney, Agent, or Firm*—Cullen, Settle, Sloman & Cantor

[57] ABSTRACT

The file cabinet securement structure includes a positive combination for eliminating accidents in offices resulting from the careless or negligent opening of file cabinets. This is achieved by arranging a file cabinet or cabinets with respect to a support and providing magnetic securement means therebetween thereby magnetically securing the file cabinet to the support. This is achieved without any mechanical fasteners being employed between the support, magnetic securement means and the file cabinet. The file cabinet has a first position when the drawers are closed with the center of gravity located within the file cabinet. It has a second position when at least one of the drawers is open and where the center of gravity is in a different position resulting in a tipping force producing a first moment about an edge at the bottom of the file cabinet tending to tip over the file cabinet. The magnetic securement means is effective when the file cabinet is at the second position to provide a counter force to the tipping force thereby producing a second moment at the edge at the bottom of the file cabinet at least equal to the first moment and in an opposite direction thereby preventing the file cabinet from tipping.

5 Claims, 4 Drawing Figures

FIG. 1
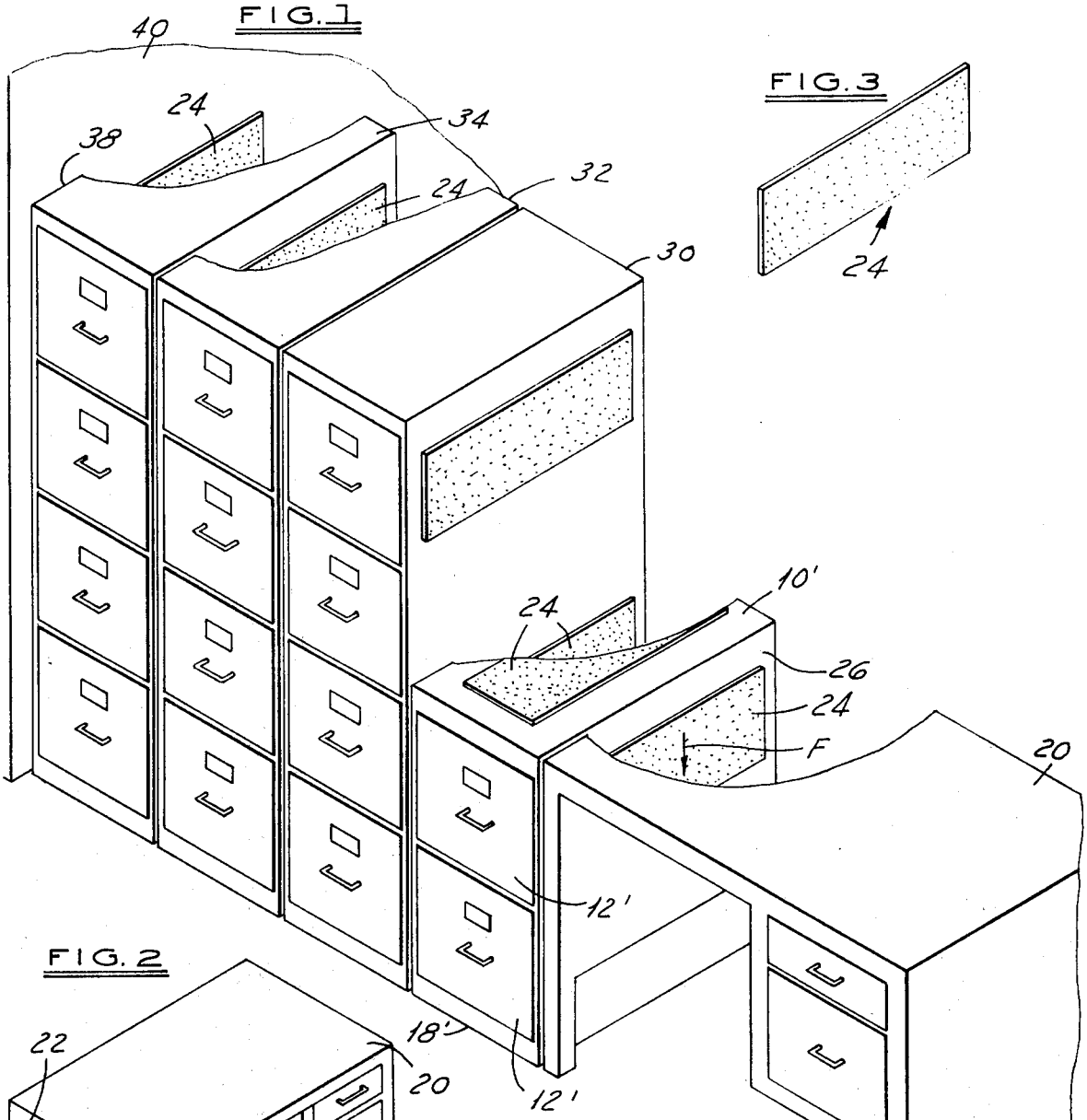
FIG. 3
FIG. 2
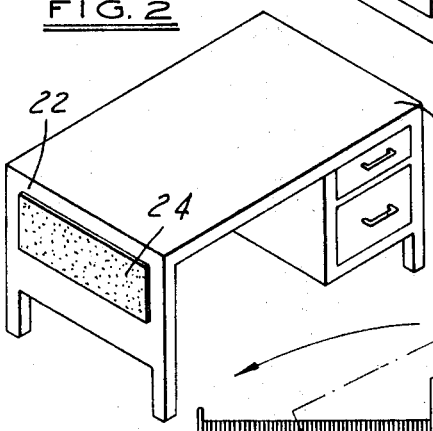
FIG. 4
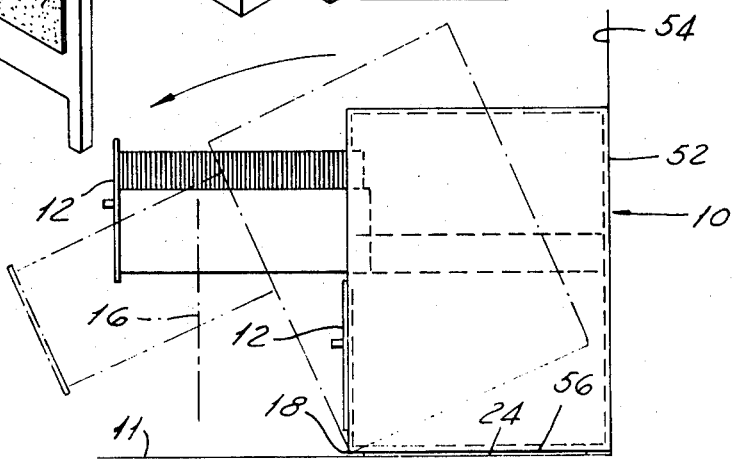

FILE CABINET SECUREMENT STRUCTURE

This is a continuation of application Ser. No. 449,729, filed Mar. 11, 1974, now abandoned.

BACKGROUND OF THE INVENTION

1. Field of the Invention

The present invention is adapted to be used in any type of building structure employing file cabinets, each cabinet consisting of two or more horizontally extendable drawers. It is adapted to be used in homes, offices, factories, or elsewhere in order to protect the saftey and well being of the person or person opening the drawers of the file cabinets.

2. Description of the Prior Art

Many large companies and offices have a policy requiring that all file cabinets be secured by bolting them to the wall, floor or to another file cabinet or cabinets in order to positively insure that the file cabinet or cabinets will not tip over on a person upon careless or negligent opening thereof. It has also been suggested that the file cabinet be bolted to a desk to prevent the file cabinet from tipping over.

Such procedures are expensive and unacceptable for many reasons. Bolting of the file cabinet to the wall or floor defaces the property and requires constant floor tile replacement, repairing or patching of the floor and also painting of the walls of the building structure. In addition, the bolting of the file cabinet or cabinets restricts the mobility of movement of desks and furniture upon business growth. Also the bolting of a file cabinet to a desk leaves permanent hole in the desk in a side thereof which causes a reduction in the value of the desk.

In a constantly expanding and growing business considerable movement of people, desks and files takes place over the months and years. Future moves are considerably expensive when considering the fact that each file cabinet and desk must be unbolted, removed to the new location and then rebolted. It is estimated that it takes one man hour of time to bolt three files into adjacent supports and further that it takes approximately 2½ hours of a person's time when it is required to bolt the file cabinet to a cement floor. When an office has, as an example, a large quantity of file cabinets it requires a relatively large expenditure to safely anchor the file cabinets besides the financial loss resulting from permanently scarring or damaging the walls, rugs, desks, etc. as explained previously.

The present invention does not require bolting of the file cabinet or cabinets to any support but rather employs magnetic securement means in the form of a flexible magnetized pad which is interposed between the support and file cabinet in such a way as to prevent the tipping of the file cabinet as explained in the Abstract and will be more fully explained hereinafter.

A preliminary novelty search was conducted in the U.S. Patent Office and the following U.S. Pat. were noted: Phelon. No. 2,565,625, dated Aug. 28, 1951; Huffman, No. 2,964,201, dated Dec. 13, 1960; Lennemann, No. 2,967,038, dated Jan. 3, 1961; Schornstheimer et al, No. 3,184,807, dated May 25, 1965; Pompa, No. 3,239,178, dated Mar. 8, 1966; O'Donnell, No. 3,700,201, dated Oct. 24, 1972; and Stokstad, No. 3,758,217, dated Sept. 11, 1973. However, none of such patents have the structural features and functional advantages of the present invention.

SUMMARY OF THE INVENTION

The employment of magnetic securement means or a flexible magnetic pad between a support and file cabinet, in one of several ways disclosed hereinafter, has been found effective to prevent the accidental or negligent tipping of the file cabinet on a person which could result in serious personal injuries. The file cabinet when normally utilized has a first position when the drawers are closed and in such case the center of gravity lies within the file cabinet. The file cabinet may also have a second position when at least one of the drawers is open causing the center of gravity to shift to a different position which results in a tipping force producing a first moment about the front edge at the bottom of the file cabinet tending to tip the cabinet.

The magnetic securement means or pad employed is effective when the file cabinet is at the second position to produce a counter force to the tipping force resulting in a second moment at the front edge at the bottom of the file cabinet. Such second moment is at least equal to the first moment and in an opposite direction thereby preventing the file cabinet from tipping over.

The magnetic securement means or flexible magnetic pad in certain applications as an example, when applied between a vertical wall and the file cabinet or between a pair of file cabinets or between a file cabinet and a side wall of the desk, is subjected to a counter force in shear when under load at the second position.

In other applications the magnetic securement means of flexible magnetic pad is provided between a vertical support and the rear wall of the file cabinet or between the floor and the bottom of the file cabinet thus subjecting same to a counter force in tension when under load at the second position.

In certain applications the magnetic securement means or flexible magnetic pad may be subjected to a counter force in shear and tension combined when under load at the second position of the file cabinet.

The magnetic securement means may take one of several forms commercially available. While relatively large steel magnets of conventional type may be utilized, such use is not commercially advantageous due to the expense involved as well as to the appearance of utilizing same and to certain weight factors. It has been found that an elongated flexible magnetic pad as an example, 10 × 24 inches and having a uniform thickness of approximately 1/16 inch may be utilized. One form of a flexible magnetic pad consists of a rubber based material with magnetic material embedded therein. As an example, barium ferrite magnetic material may be utilized with the rubber based material. In another form of a flexible magnetic pad the barium ferrite material is mixed with a suitable resin binder of the types disclosed in U.S. Pat. No. 3,184,807 to provide a magnetic pad having the requisite holding force and a life of many years.

With the present invention the marring of walls, rugs, floors, desks and the like is eliminated since no mechanical connections are provided between the support, file cabinet and the magnetic securement means. It is, of course, appreciated that the magnetic securement means can only be utilized with metal file cabinets and with metal supports all of which are capable of being attracted by the flexible magnetic pad. Thus, the present invention will result in an economical saving of workman's time and in the reduction of damage to property.

DESCRIPTION OF THE DRAWING

FIG. 1 is a perspective view illustrating how the present invention may be utilized with a wall or a floor of a building structure, with a plurality of file cabinets and with a desk;

FIG. 2 is a perspective view of a desk showing a flexible magnetic securement pad on one side thereof;

FIG. 3 is a perspective view of a flexible magnetic securement pad; and

FIG. 4 is a side view of a file cabinet in two positions, with the file cabinet represented by the solid lines of one position having a drawer thereof extended and with the file cabinet and drawer being shown by dotted lines in the second and tipped position.

DESCRIPTION OF A PREFERRED EMBODIMENT

The problem to which the present invention is directed is illustrated in FIG. 4. The file cabinet 10 resting on floor 11 consists of two horizontally extendable drawers 12. When the drawers 12 are closed, loaded or unloaded, the center or gravity of the cabinet is within the confines of the cabinet 10. In certain instances when one of the drawers 12 is extended and is loaded, the center of gravity shifts to a position represented by the line 16 of FIG. 1. As a result thereof, the file cabinet 10 tips as represented by the dotted lines in FIG. 4. This tipping occurs about the front edge 18 of the file cabinet 10. A first moment is created determined by multiplying the weight of the loaded cabinet by the perpendicular distance between the front edge 18 and the center of gravity of the extended cabinet. Since there is no moment opposing the first moment the file tips. In certain cases a person who is negligent or careless in opening a cabinet is seriously injured by the cabinet falling upon them.

FIG. 2 illustrates a metal desk 20 having on one vertical side 22 thereof an elongated magnetic securement means or flexible magnetic pad 24. The pad 24, as an example, is of uniform thickness of approximately 1/16 inch and has other dimensions of 10 × 24 inches. When pad 24 is applied to surface 22 it os magnetically attracted thereto. As shown in FIG. 1 the file cabinet 10' has one vertical side wall 26 which abuts the metal desk 20 whereby the magnetic pad 24 is secured to the file cabinet 10' and to the desk 20.

If one of the drawers 12' of file cabinet 10' is opened to result in a force and first moment tending to tip the cabinet as explained previously, the magnetic pad 24 is subjected to a shearing or counter-force F which multiplied by the perpendicular distance between the front edge 18' and said shearing or counter-force F results in a second moment which is at least equal to the first moment and in an opposite direction thereby preventing the file cabinet from tipping.

The present invention may be employed with a single file cabinet such as file cabinet 10' having two drawers or may be employed with any number of file cabinets 30, 32 and 34 having, as an example, four drawers as shown in FIG. 1.

It will be noted in FIG. 1 that adjacent file cabinets 30 and 32 have opposing vertical side walls and placed between such side walls is the magnetic securement means, not shown, which may be in the form of a pair of flexible magnetic pads 24 spaced vertically apart. File cabinets 32 and 34 also have opposing vertical side walls with one or more pads 24 interposed therebetween and magnetically secured thereto.

File cabinets 34 has another vertical side wall 38 directly opposite a vertical wall 40 of the building structure. Vertical wall 40 has an exposed area or areas whereby one or more of the magnetic securement pads 24 are interposed therebetween to magnetically secure file cabinet 34 to vertical wall 40.

The flexible magnetic pads 24, when applied between the vertical surfaces of the wall 40, side surfaces of the cabinets 30, 32 and 34 as well as between the sides of the cabinet 10' and desk 20, are all hidden from view since the pads 24 are spaced inwardly from the edges of the opposing surfaces of the cabinets and supports shown in FIG. 1. As stated previously the pads 24 have a thickness of only 1/16 inch although pads of other thicknesses may be used. The size and thickness of the pad selected is dependent in part upon the magnetic force of attraction as well as the shear force of the pad so that it is capable of producing a second moment in opposition to the tipping or first moment.

The flexible magnet pad 24 may also be used in connection with the rear or back surface 52 of the file cabinet 10 (FIG. 4) whereby a pad (not shown) is interposed between the surface 52 and the abutting wall 54. When the tipping movement occurs the pad interposed between surfaces 52 and 54 would be placed in tension and would create a moment about the front edge 18 opposing the tipping moment.

A flexible magnetic pad 24 may also be interposed between the bottom surface 56 of the metal cabinet 10 and a metal floor 11 as best shown in FIG. 4. When the tipping moment occurs the pad 24 is subjected to a tensile force resulting in a second moment opposing the tipping moment.

It should be appreciated that a plurality of flexible magnetic pads 24 may be utilized with a single file cabinet. As an example, one pad 24 may be utilized between the rear wall of the cabinet and an opposing vertical support (with the pad subjected to a tensile force) as well as between a side wall of the cabinet and either a vertical wall of the structure or of a desk or adjacent file cabinet (with the pad subjected to a shear force). Thus in certain applications the magnetic securement means may be subjected to a counter-force in shear and tension combined under load at the second position of the file cabinet. In addition a flexible magnetic pad 24 may be mounted on the top surface of the file cabinet 10' and a second file cabinet 10' placed on top of the flexible pad 24 and the top surface of cabinet 10'.

The file cabinets may be of any size and height and have any number of drawers beyond two. As an example a conventional two drawer file cabinet has a height of 29 inches, a depth of 28 inches and a width of 15 inches. The number of flexible magnetic pads used in any application and the size of each pad would depend in part upon how the file cabinet or cabinets are loaded, the location of the loads or typical loads to be encountered and other factors.

The magnetic pad 24 is flexible or yieldable and is of light weight construction. It may be in the form of any number of magnetic pads or magnets now commercially available. It may take the form of a rubber based material with magnetic material embedded therein, as an example, barium ferrite particles. The pad may also contain barium ferrite partilces within a resin binder such as the material or materials disclosed in U.S. Pat. No. 3,184,807 dated May 25, 1965.

One piece of a flexible permanent magnet, in the form of a semi-rigid rubber compound material, was tested to determine the amounts of metals located therein. The metals content was determined by emission spectrograph. The test results are as follows:

| | |
|---|---|
| Organic Portion | 8.8% |
| Inorganic Portion | |
| Barium Oxide | 5.5% |
| Iron Oxide ($Fe_3O_4$ | 94.5% |
| The metals are present in the form of Barium Ferrite. | |

Another form of flexible permanent magnet which may be used with the present invention is sold by the 3M Company under the trademark PLASTIFORM. Such magnet is described in the four page brochure [DMS-MB-2(495) CPI] published by the Dielectric Materials & Systems Division, 3M Company located at 5178 Crookshank Road, Cincinnati, Ohio 45238. Such magnets are in the form of rubber-bonded barium ferrite composite materials. The magnetic and physical properties of such magnet are described in the brochure.

What is claimed is:

1. The combination of a support, a file cabinet with a plurality of drawers therein, each drawer being extendable in a first direction, and magnetic securement means interposed between and magnetically secured to opposing surfaces of said support and said file cabinet, said magnetic securement means being secured to said support and to said cabinet solely by magnetic attraction and without any mechanical fasteners therebetween so as to normally prevent relative motion in any direction between said opposing surfaces, said magentic securement means including a plurality of thin, flexible magnetic pads of generally uniform thickness, said pads containing finely divided magnetic particles united by a flexible finder, said file cabinet having a first position when the drawers are closed with the center of gravity located within said file cabinet having a second position when at least one of the drawers is extended in said first direction to an open position where the center of gravity is in a different position resulting in a tipping force producing a first moment about an edge at the bottom of the file cabinet tending to tip the file cabinet, said magnetic pads when said file cabinet is at said second position providing a counter force producing a second moment at said edge at the bottom of the file cabinet at least equal to said first moment and in an opposite direction thereby preventing said file cabinet from tipping.

2. The combination defined in claim 1 wherein a pair of magnetic pads are interposed between said support and said file cabinet, said magnetic pads being spaced apart.

3. The combination defined in claim 1 wherein said pad is subjected to a counter force in shear when under load at said second position.

4. The combination defind in claim 1 wherein said pad is subjected to a counter force in tension when under load at said second position.

5. The combination defined in claim 1 wherein said pad is subjected to a counter force in shear and tension combined when under load at said second position.

* * * * *